United States Patent [19]

Baroni

[11] Patent Number: 4,513,755

[45] Date of Patent: Apr. 30, 1985

[54] CONTROL DEVICE FOR REGULATING THE FEEDING OF CUT TOBACCO TO A CIGARETTE MAKING MACHINE

[75] Inventor: Bruno Baroni, San Giorgio di Piano, Italy

[73] Assignee: SASIB S.p.A., Bologna, Italy

[21] Appl. No.: 371,475

[22] Filed: Apr. 23, 1982

[30] Foreign Application Priority Data

Apr. 30, 1981 [IT] Italy ..... 12514 A/81

[51] Int. Cl.[3] ..... A24C 5/18

[52] U.S. Cl. ..... 131/84 C; 131/108; 131/110; 131/906; 131/909

[58] Field of Search ..... 131/84 R, 84 C, 108, 131/109 R, 109 B, 109 AB, 110, 906, 909; 222/55

[56] References Cited

U.S. PATENT DOCUMENTS

| | | | |
|---|---|---|---|
| 3,052,242 | 9/1942 | Levadi | 131/280 |
| 3,130,733 | 4/1964 | Martin | 131/280 |
| 3,146,780 | 9/1964 | Harrison, Jr. et al. | 131/280 |
| 3,146,910 | 9/1964 | Varner | 222/55 |
| 3,504,679 | 4/1970 | Lowman | 131/280 |
| 3,738,376 | 6/1973 | Labbe et al. | 131/280 |
| 3,850,177 | 11/1974 | Labbe | 131/84 C |
| 3,955,584 | 5/1976 | Molins et al. | 131/280 |
| 4,036,238 | 7/1977 | Okumoto | 131/280 |
| 4,185,644 | 1/1980 | Hietmann | 131/109 AB |
| 4,235,248 | 11/1980 | Schumacher | 131/108 |
| 4,249,544 | 2/1981 | Reuland et al. | 131/280 |
| 4,373,538 | 2/1983 | Steiniger | 131/108 |

*Primary Examiner*—V. Millin

*Attorney, Agent, or Firm*—Spencer & Frank

[57] ABSTRACT

This invention relates to an automatic control device adapted to regulate, without interruptions, cigarette-making process and in a substantially continuous way, the cut tobacco being re-circulated back to the distributor, as trimmed excess tobacco (S) from the uniform tobacco rod, formed in the pneumatic suction belt forming assembly (N) of a continuous cigarette-making machine. Said device substantially comprises a detector suction head (1), through which all of said trimmed excess tobacco (S) is passed pneumatically, in its path of suction re-circulation, from trimmer (R) of the belt (N) the distributor of the cut tobacco for the formation of the rod. Said detector suction head (1) is associated with a photo-cell sensor (4, 5) whose light beam is liable to be attenuated by the total flow of trimmed cut tobacco (S) sucked through said head. Depending upon the intensity of said attenuation, said optical sensor (4, 5) generates a primary measurement and control signal indicating the specific output of said excess tobacco. Associated with the detector suction head (1), inserted in the sucking ducts (2, 3) from the trimmer (R) to the distributor, is a regulatable means for controlling the total flowrate of the distributor, adapted to control said flowrate as a function of said primary measurement signal indicating the recirculated excess tobacco (S) to said distributor.

13 Claims, 5 Drawing Figures

CONTROL DEVICE FOR REGULATING THE FEEDING OF CUT TOBACCO TO A CIGARETTE MAKING MACHINE

BACKGROUND AND SUMMARY OF THE INVENTION

In the cigarette making machines, a continuous trimmed rod of cut tobacco is formed on a pneumatic suction belt and is then associated with a paper wrapping web to form a continuous cigarette rod, to be severed finally into individual cigarette lengths.

The cut tobacco for said rod is fed by the feeding hopper of the distributor, and the tobacco trimmed away from the rod, i.e. the trimmed excess tobacco, is recirculated to said hopper, and more particularly to a pre-hopper. Therefore, in the cigarette making machines, the distributor will not feed the cut tobacco in the strict amount which is necessary to for the tobacco rod, but in an excessive amount so as to permit the trimming away of the outside irregularities of the rod and thus to effect an exact sizing thereof. The amount of trimmed excess tobacco depends on the excess of the total flowrate fed from the distributor. By "total flowrate" is meant the sum of the rate of flow of cut tobacco actually used to form the rod and of the rate of flow of the recirculated trimmed excess tobacco.

The percentage of the recirculated trimmed excess tobacco is the ratio between the weight of the trimmed tobacco and the sum of the weights of both the trimmed tobacco and the tobacco issued as a rod. Practically, therefore, in order to determine this percentage, the cigarette production is to be discontinued temporarily in order to collect in two containers, for the same time interval, the tobacco not yet wrapped in the paper as outflowing from the rod formation, and the trimmed tobacco, respectively. Thereafter, by weighing these two collected amounts and by calculating the ratio between the weight of the trimmed tobacco and the total weight of the tobacco coming from the trimming and rod-formation steps, the percentage of recirculated tobacco will be obtained.

The optimum value of this percentage is a typical characteristic in cigarette manufacturing, and it must be set in a cigarette making machine at the beginning of the manufacturing process. Practically, however, during the manufacturing process, deviations or drifts occur between said pre-set optimum value and the actual value of the percentage of recirculated tobacco. These deviations, in the present status of the art, are determined and corrected by calculating the values of the percentage at pre-established intervals, and by regulating as necessary the total flowrate of the cut tobacco fed by the distributor. Of course, these calculations cannot be made too often, as they entail the shutdown of the operation.

Summarizing, the present regulation of the percentage of recirculated tobacco is performed in an empirical operation to be repeated from time to time, with obvious inconveniences.

The invention aims to thoroughly eliminate these drawbacks, and for this purpose it provides a control device for automatically regulating the percentage of cut tobacco being recirculated as trimmed excess tobacco, said device being adapted to match, substantially continuously, the actual value of said percentage with a pre-set optimum value of said percentage. This regulation is effected without interrupting the manufacturing of the cigarette rod, continuously and during successive time intervals which are equal to each other and adjustable, so as to automatically regulate accordingly the total flowrate of cut tobacco fed by the distributor.

BRIEF DESCRIPTION OF THE DRAWINGS

The features of the invention and the advantages resulting therefrom will be apparent from the following detailed description of a preferred embodiment thereof, made by way of non-limiting example, with reference to the accompanying drawings, wherein.

DESCRIPTION OF THE PREFERRED EMBODIMENT

Figure 1:
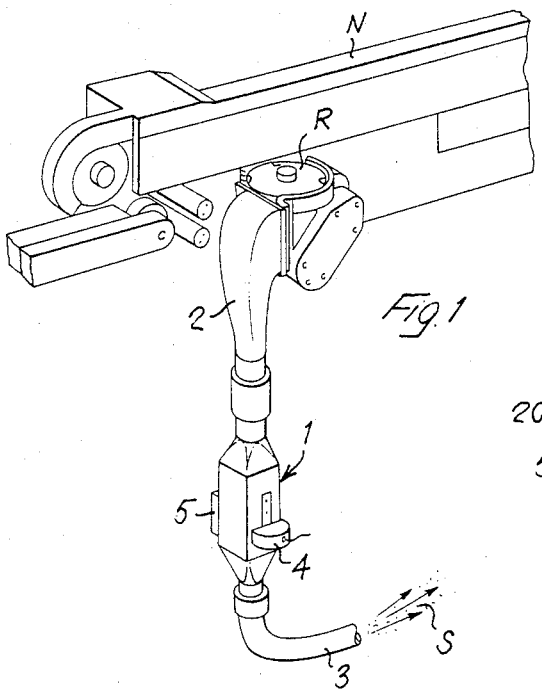
FIG. 1 is a perspective view of a detector suction head for the trimmed excess tobacco, adapted to be mounted on a device for regulating the percentage of trimmed tobacco being recirculated to the distributor of a cigarette making machine, according to the invention.
Figure 2:
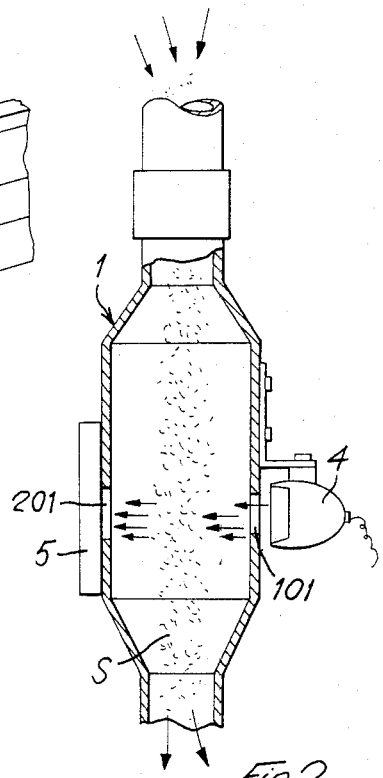
FIG. 2 is a sectional view of the detector head of FIG. 1.

FIG. 1 shows diagrammatically the detector head 1 of the control device according to the invention, used on a cigarette making machine of the type wherein the tobacco rod, formed on a suction belt N, before being wrapped in the paper to form the continuous cigarette rod, is submitted to the action of two trimmers R to be exactly sized thereby, by trimming away therefrom any outside irregularity.

The trimmed away tobacco, i.e. the trimmed excess tobacco, is drawn into a suction hood 2 and is recirculated to the pre-hopper of a distributor of the cigarette making machine, through a flexible suction hose 3 and a star-shaped valve, so as to pass through a detector head 1. The head 1 comprises a sleeve operatively interposed between the suction hood 2 and the hose 3. This sleeve, which is of substantially square cross section, has two end portions so shaped as to progressively change their cross sections from the square shape into a circular shape, so as to merge the head with the suction hood 2 and hose 3.

Two opposed vertical walls of the sleeve 1 are formed with slots 101 and 201, respectively, provided with sealed protective glass plates. Located at the slot 101 is a light source 4, and located at the opposite slot 201 is a photo-sensor 5 formed, for example, by photovoltaic cells which, as well known, generate an electric current which is proportional to the incident light.

Since the sleeve 1 is traversed by the flow of recirculated tobacco, it is apparent that this flow behaves as a screen which is interposed between the light source 4 and the photo-voltaic cells 5, and that it attenuates more or less the light beam therebetween. The intensity of the current generated by these cells will be, therefore, inversely proportional to the density of the flow recirculated cut tobacco, i.e. to the flowrate of this tobacco.

Figure 3:
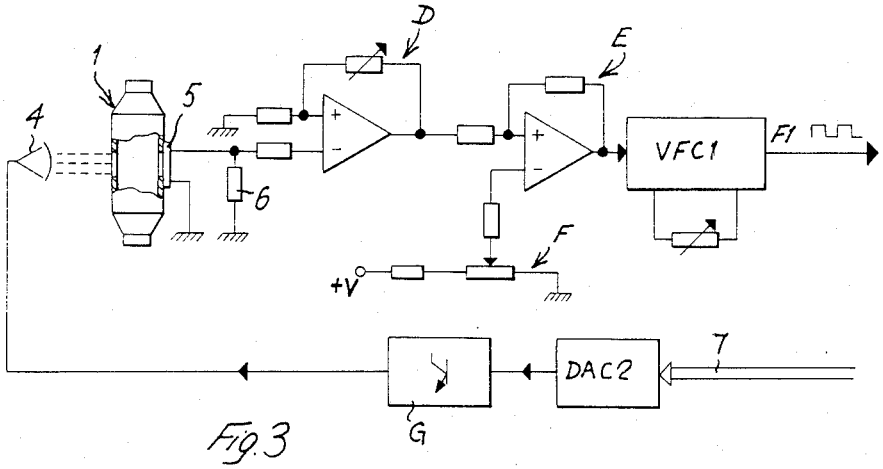
FIG. 3 is a block diagram of the electronic circuit used with the detector head of FIGS. 1 and 2 to obtain a frequency signal representing the actual flowrate of the trimmed recirculated tobacco.

The photo-voltaic cells 5 are inserted in the electronic circuit of FIG. 3 to generate a frequency signal F1 which is proportional to the flowrate of the recirculated trimmed excess tobacco. They operate as described hereinafter.

With reference to the diagram of FIG. 3, the electric current which is generated by the action of the light in the photo-voltaic cells 5 is converted into a voltage signal by closing the circuit of said photocells on a resistor 6. The resulting voltage signal is supplied to an inverter D whose output will be, therefore, directly proportional to the flowrate of recirculated tobacco. This signal, brought to the desired level from a stage E together with a reference voltage F, is finally converted by a voltage-frequency converter VFC 1, into a frequency F1 which is directly proportional to the recirculated flowrate of tobacco.

Assuming that the cigarette making machine is provided with a device for regulating automatically the weight of cigarettes, the flowrate of actually used tobacco to form the rod is directly proportional to the speed of movement of the belt N. Therefore, by measuring this speed, for example by a speedometer dynamo DT, a signal can be obtained representing the actual value of the latter flowrate.

Figure 4:
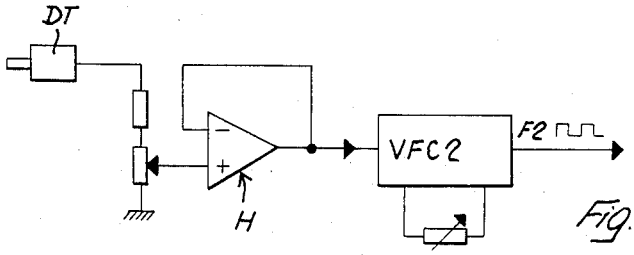
FIG. 4 is a block diagram of the electronic circuit used to obtain a frequency signal representing the actual flowrate of cut tobacco really used to form the exactly-sized rod, assuming that the cigarette making machine is provided with an automatic cigarette weight regulating device.

This is achieved by means of the circuit of FIG. 4, where the voltage signal from the speedometer dynamo DT, after passing through a de-coupling stage H, is supplied to a voltage-frequency converter VFC 2, where it is converted into a frequency F2 which is proportional to the speed of movement of the rod-forming belt N, and, therefore, to the flowrate of the cut tobacco now formed into a trimmed rod.

Figure 5:
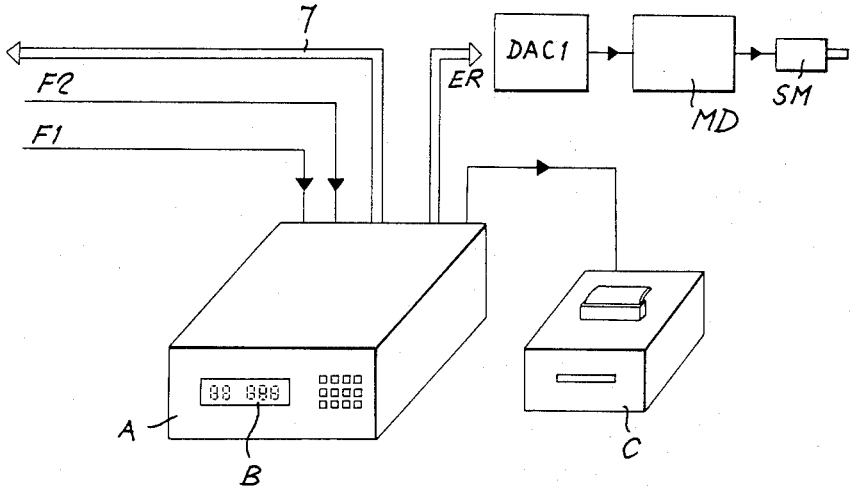
FIG. 5 is a block diagram showing how the frequency signals generated in the circuits of FIGS. 3 and 4 are used together, through an electronic microprocessor to generate a regulating signal to adjust the action of the servo-motor controlling the flowrate of the distributor of cut tobacco.

As shown by the block diagram in FIG. 5, the two frequencies F1, F2, obtained as specified above, are supplied, together, to the inlets of a micro-processor A which counts, for each of the said frequencies, the number of pulses in a given period of time (which can be regulated, for example, from 1 to 99 seconds), said period corresponding to the desired time for the measurement of the percentage of recirculated tobacco.

The micro-processor A effects automatically, in the pre-established period of time, the evaluation of the percentage of recirculated tobacco by calculating the ratio between the number of pulses counted for the frequency F1 (representing the weight of the recirculated tobacco) and the sum F1+F2 of the corresponding total number of pulses counted for the frequencies F1 and F2 (representing the total weight of the tobacco outflowing in the same period of time from the distributor).

The micro-processor A also calculates, in the same pre-established period of time, the difference between the measured value of the percentage of recirculated tobacco and the optimum reference value, which can be regulated. This difference is the error signal ER which, after being converted from the digital to the analogic form in the converter DAC 1, will be fed to the control apparatus MD for the variable-speed servo-motor SM that controls the total flowrate of the cut tobacco from the distributor.

The measured value of the percentage of recirculated tobacco will be displayed on a visualizer B, which also indicates the value of the corresponding time period of measurement.

A printing machine C, connected to the outlet of the micro-processor A, will record the successive percentage values as measured in the successive time periods as well as these corresponding time periods and respective output rates of the cigarette making machine.

In order to obtain reliable measured values of the tobacco percentages, the optical detection system 4, 5 must be unaffected by any error-producing factors. One of these factors is constituted by the different colors of tobacco, whereby suitable optical filters will be used to have the measurement of the percentage unaffected thereby.

Another error-producing factor in measuring the percentage of recirculated tobacco is the uneven rate of illumination of the photo-voltaic cells 5, which illumination decreases as the light source 4 (lamp) becomes older, and depends upon the fluctuations of the feed voltage of the light source.

In order to make the measurement of the percentage unaffected also by this factor, the procedure specified hereinafter is followed.

The light source 4 is fed by a stabilized feeder G controlled by the output 7 of the micro-processor A through the digital-analogic converter DAC2 (FIG. 3).

During the shutdowns of the cigarette making machine (FS=0), the frequency F1 is examined by counting the number of pulses in a given period of time (for example, 100 ms), and this number is compared with the number of reference pulses, which is regulatable and proportional to the voltage F. Depending upon the difference, the feed voltage of the lamp is acted upon until the desired pre-established number of pulses is obtained.

The calibration is displayed by two LED diodes, both turning on when the voltage either increases or decreases. When the calibration is exact, both diodes are off or, if desired, are turned on alternately.

In case of break-down, such as for example a failure of the lamp 4, obstruction in the sleeve 1, cutoff of the electrical connection between the measuring head and micro-processor A, error-indications on the visualizer B will be displayed by means of numerical codes.

Finally, it is to be recalled again that the control device according to the invention is supposed to be used on a cigarette making machine provided with an automatic device for checking the weight of the cigarettes.

In the absence of the latter device, the measurements of the percentages of recirculated tobacco, effected as specified above, will lack of reliability because the assumption of uniform and constant density of the produced rod of cut tobacco cannot be supported.

Obviously, the invention is not limited to the embodiment herein shown and described by way of example, but broad changes and modifications can be made thereto, especially depending upon particular and contingent requirements of specific practical circumstances, without departing from the broadest scope of the inventive principles, as set forth above and as claimed hereinafter.

I claim:

1. An automatic control device for regulating with no interruption in the cigarette manufacturing process, the cut tobacco recirculated to the tobacco distributor, as excess tobacco trimmed from the uniform tobacco rod produced in the suction belt forming assembly of a continuous cigarette making machine, characterized in that it comprises a detector suction head inserted in the suction duct from the trimmer to the distributor, the whole of said trimmed excess tobacco being passed therethrough on its suction recirculation path from the trimmer at the rod-forming belt to the distributor of the cut tobacco, said head being associated with a photoelectric sensor whose light beam can be attenuated by the total flow of trimmed tobacco being sucked through said head, said sensor generating, as a function of the value of this attenuation, a primary control and measurement signal representing the specific production of trimmed tobacco, said detector head having associated therewith adjustable means adapted to control the flowrate of the distributor as a function of said primary measurement signal representing the amount of trimmed excess tobacco recirculated to said distributor.

2. An automatic control device for regulating the excess trimmed tobacco recirculated from the tobacco trimmer to the tobacco distributor of a continuous cigarette making machine, by generating a photo-electric measurement signal representing the flowrate of the recirculated trimmed tobacco, said signal being adapted to regulate means controlling the total flowrate of the distributor so as to adjust this flowrate as a function of the flowrate of trimmed tobacco, according to claim 1, characterized in that said means controlling the total flowrate comprises a servo-motor of the distributor, a numerical electronic processor adapted to control said servo-motor, and a transducer circuit adapted to convert the physical characteristics of said photo-electric signal generated in the detector head, so that it can be received at the inlet of said numerical processor.

3. An automatic control device for the trimmed excess tobacco, according to claim 2, characterized in that said transducer circuit, adapted to convert the physical characteristics of said photo-electric signal so that the latter can be received into the numerical processor, consists of a resistive network adapted to produce a first voltage signal which is directly proportional to the current which is generated by the photo-responsive elements, an inverter to invert this voltage signal, so as to obtain therefrom a second voltage signal which is directly proportional to the recirculated flow of the trimmed tobacco, and a voltage-frequency converter assembly, associated with a regulator with a reference frequency, for converting said second voltage signal into a first frequency signal representing said flowrate of recirculated trimmed tobacco, said first frequency signal being fed to an inlet of side electronic processor.

4. An automatic control device for the trimmed excess tobacco, according to claim 3, characterized in that said transducer circuit also comprises a branch having a transducer adapted to generate a voltage signal representing the speed of the tobacco-rod forming belt, and a second voltage-frequency converter to convert this voltage signal into a frequency signal also representing the speed of said belt, the latter frequency signal being fed to a second inlet of said electronic numerical processor.

5. An automatic control device according to claim 4, characterized in that it comprises also an automatic regulator of the weight of the cigarettes produced by the cigarette making machine, so that said frequency signal representing the speed of the belt, also represents the actual weight flowrate of the cut tobacco which is really used for forming the rod.

6. An automatic control device according to claim 2, characterized in that said numerical processor consists of a micro-processor.

7. An automatic control device for regulating continuously the flowrate of the recirculated trimmed excess tobacco, according to claim 2, characterized in that said numerical processor is programmed to calculate, in pre-established periods of time, selected in a pre-set range of periods, the percentage flowrate of the recirculated trimmed excess tobacco, reference to the total flowrate of the cut tobacco delivered by the distributor, said calculation being made starting from said frequency signals representing either the flowrate of recirculated trimmed tobacco, or the useful flowrate of tobacco for the rod, respectively.

8. An automatic control device according to claim 7, characterized in that the numerical processor is also programmed to compare the result of the percentage flowrate of the recirculated tobacco, with a pre-established optimum percentage, and this comparison generates a numerical regulating signal, or error signal, designed to accordingly match the total flowrate of the distributor so as to bring it again towards said optimum percentage.

9. An automatic control device according to claim 8, characterized in that said servo-motor for the distributor is controlled by said numerical error signal, issued from the processor, through a digital-analogic decoder and a control circuit of said servo-motor.

10. An automatic control device for regulating the percentage flowrate of the trimmed recirculated tobacco, according to claim 2, characterized in that it comprises a return circuit from the numerical processor to the light source of the photo-electric element, to check the calibration of the device and the preservation of said calibration in the time, by checking the intensity of the emission of light from said source.

11. An automatic control device for regulating the total flowrate of the cut tobacco from the distributor as a function of the flowrate of the recirculated trimmed excess tobacco, according to claim 1, characterized in that said photo-electric sensor of the detector head which detects the specific production of the trimmed tobacco consists of an optical sight means comprising an adjustable source of light and a photo-responsive element optically in line therewith across the path of travel of the recirculated flow of the trimmed tobacco through said head, said element thus generating an electric current depending upon the attenuation of the light beam of said optical sight means on passing through the flow of trimmed tobacco being recirculated.

12. A control device according to claim 11, characterized in that said photo-responsive element of the photo-electric sensor in the detector head for the recirculated flow of trimmed tobacco is formed by photovoltaic cells, said cells regulating a current which is directly proportional to the incident light and, therefore, inversely proportional to the recirculated flow of the trimmed tobacco.

13. An automatic control device for use in combination with a continuous cigarette making machine, the machine including a tobacco distributor, a suction belt assembly for forming a uniform tobacco rod from cut tobacco dispensed by the tobacco distributor, a trimmer adjacent to the suction belt assembly for trimming excess tobacco from the uniform tobacco rod and a suction duct between the trimmer and the distributor for recirculating the trimmed excess tobacco to the distributor, said control device being operative for regulating the amount of recirculated tobacco without interrupting the operation of the cigarette making machine, said device comprising:

a detector head disposed in said suction duct, all of the trimmed excess tobacco being passed through said detector head, said detector head including a light source for producing a light beam and a photoelectric sensor disposed for receiving the light beam and producing a measurement signal proportional to the intensity of the light beam, the light beam attenuated by the trimmed excess tobacco passing through said head, wherein the measurement signal represents the amount of trimmed excess tobacco being recirculated to the distributor; and adjustable means connected for receiving the measurement signal and for controlling the tobacco dispensing rate of the distributor as a function of the measurement signal.

* * * * *